US006200421B1

(12) United States Patent
Meinander

(10) Patent No.: US 6,200,421 B1
(45) Date of Patent: Mar. 13, 2001

(54) APPARATUS AND PROCESS FOR FEEDING STOCK TO A PAPERMACHINE

(75) Inventor: Paul Olof Meinander, Grankulla (FI)

(73) Assignee: Pom Technology Oy AB, Helsongfors (FI)

( * ) Notice: Subject to any disclaimer, the term of this patent is extended or adjusted under 35 U.S.C. 154(b) by 0 days.

(21) Appl. No.: 09/101,734

(22) PCT Filed: Jan. 25, 1996

(86) PCT No.: PCT/FI96/00052

§ 371 Date: Jul. 16, 1998

§ 102(e) Date: Jul. 16, 1998

(87) PCT Pub. No.: WO97/27359

PCT Pub. Date: Jul. 31, 1997

(51) Int. Cl.[7] ..... D21F 11/00

(52) U.S. Cl. ..... 162/198; 162/253; 162/216; 162/336; 162/258; 162/259; 162/DIG. 10; 162/252

(58) Field of Search ..... 162/198, 253, 162/216, 336, 258, 259, DIG. 10, 252

(56) References Cited

U.S. PATENT DOCUMENTS 1,600,731 * 9/1926 Hall .
3,572,361 * 3/1971 Terhar .
3,586,601 * 6/1971 Persik .
3,620,915 11/1971 Keyes, IV et al. .
3,650,891 * 3/1972 Dahlin .
4,308,095 * 12/1981 Brendemuehl ..... 162/253
4,755,743 * 7/1988 Jakkula .

FOREIGN PATENT DOCUMENTS 9323612 11/1993 (WO) .
9616226 5/1996 (WO) .

OTHER PUBLICATIONS

Smook, Gary A., Handbook For Pulp & Paper Technologists, Angus Wilde Publications, pp. 121–125, 1992.*

* cited by examiner

*Primary Examiner*—Stanley S. Silverman
*Assistant Examiner*—Mark Halpern
(74) *Attorney, Agent, or Firm*—Browdy and Neimark

(57) ABSTRACT

The invention relates to an apparatus and a process for feeding papermaking stock to a papermachine. The apparatus comprises a mixing vessel (12) for receiving and mixing stock components and a pipe (40) for feeding the resulting mixed stock to said papermachine. In the feeding pipe (40) there are stock flow metering means (42) stock consistency sensing means (44) and stock flow control means (32). Said means are all connected to a control system (46) adapted for receiving said flow data (Q) and said consistency data (C). The control system (46) is adapted for continuously computing a value for the product (Q×C) of said flow and consistency and for providing adjustment of the flow control means (32) to keep said product (Q×C) at a target value. The invention provides faster response times in the control of a papermaking process. It also reduces the volume of stock mixing vessels and the amount of water in the process.

20 Claims, 2 Drawing Sheets

APPARATUS AND PROCESS FOR FEEDING STOCK TO A PAPERMACHINE

The present invention relates to an apparatus for feeding papermaking stock to a papermachine and to an improved process for producing paper. The present invention provides a method for compensating consistency variations when feeding stock to a papermaking machine. It also provides a method for the fast and exact changing of stock composition when changing paper grades or correcting product characteristics.

In a papermaking process of the prior art, in order to obtain a well controlled and uniform stock, the stock components are normally metered into a stock mixing tank. The mixed stock is further fed to a second tank, called the machine tank.

In the art of papermaking the flow of dry substance is traditionally controlled volumetrically, keeping the consistency or solids contents at a constant level by means of control loops including consistency sensors and dilution means. Due to the time lag inherent in the dilution process, the control cannot be very exact and is subject to variations. Therefore the dilution is made in multiple steps and the variations are compensated by large tanks. The tank volumes are dimensioned according to the machine production capacity, and typically have a capacity for about ten minutes of production.

The water balance of the short circulation of a papermaking process requires that excess water brought with the stock into the circulation has to be removed into a longer circulation. Thereby also material contained in the removed water is transferred to the long circulation, and is either lost or has to be recovered by fiber recovery units.

Constant stock feeding requires a good and uniform function of the stock feeding pump. A prerequisite herefore is a sufficient pressure on the suction side of the pump, which is obtained by a sufficiently high level of stock in the respective tank.

In commonly used conventional papermaking processes stock is fed to the suction side of a mixing pump, drawing dilution water from an open, constant-pressure backwater tank. The stock is commonly fed over a constant-level stock box over a so called basis weight valve controlling the flow of solid stock as a function of stock consistency, pressure difference and friction. The circulating backwater volume in conventional processes is huge, and reaching equilibrium after a change in stock composition takes several minutes. The same inventor, in WO 93/23612 (Fl Patent 89728) presents a solution which provides faster grade changes by reducing the volumes of circulating stock and water involved. The disclosure of WO 93/23612 is considered included herein by reference.

When changing the composition of the stock in prior art papermaking processes, for instance when changing paper grade, the stock fed to the mixing chest is changed, whereby the composition of the stock in the mixing chest gradually changes until it corresponds to the stock composition fed to the chest. Correspondingly, the composition of stock fed to the machine chest changes providing a further delay. This causes off grade paper to be produced during grade changes and also before a corrective stock change has reached the paper machine.

With conventional papermaking processes this does not cause a great problem, because the time needed for reaching an equilibrium is determined by the short circulation rather than by the stock feeding. However, the short circulation process of the above mentioned WO 93/23612 is fast and requires a process providing fast and exact control of the stock composition.

Recently new consistency sensors functioning on the principles of micro-wave technology have been developed. One example is a sensor named "Kajaani MCA", marketed in Finland by Oy Valmet Fisher Rosemount Ab. The new micro-wave sensors have improved measurement of the consistency to an accuracy permitting a fast and accurate control of solid contents over a wider range of variable conditions, such as flow speed, pressure, temperature and stock composition, than previously used types of sensors.

In the industry these sensors are gaining foothold for a more accurate monitoring and control of stock consistency. The accurate monitoring of stock consistency has so far been used for providing a more accurate dilution response in the tanks preceding the stock feeding pump so as to achieve, as closely as possible, a constant consistency which is required for a proper functioning of the down-stream papermachine.

The present inventor has realized that it is not necessary for the stock being supplied to the papermachine to have a constant consistency. Other process parameters, and especially the flow of stock can be adjusted to compensate for any consistency variations as long as the amount of solid material being fed to the papermachine is kept at a constant value.

Numerous advantages can be gained from this invention not only in the art of making paper but also in the art of making boards of various kinds. The term "paper" as used in the present specification and claims is thus intended to include not only paper and board produced in conventional paper machines, but also any kinds of webs and sheets produced from a slurry by spreading the slurry onto a web-forming wire.

An object of the present invention is to improve known methods for feeding stock to a papermachine and to provide a fast and exact feeding of paper stock of a desired composition to the machine.

An object of the invention is also to provide a stock feeding arrangement with a fast reaction to changes in stock composition.

A special object of the invention is to provide a feeding arrangement, which combines a small stock volume with an efficient stock mixing and a stable and adequate pump feeding pressure.

An object is further to provide means for neat changes of paper grades, by separating the old stock and the new stock at the grade change.

A further object of the invention is to eliminate the disturbances caused by dilution in stock consistency control.

A further objective is to provide an arrangement for feeding stock to a paper machine at a relatively high consistency, without using dilution as a means for providing feed stock consistency control.

A particular object of the invention is to provide means for changing paper grade fast and exactly in connection with a compact papermaking process.

The apparatus aspect of the invention defines an apparatus for feeding papermaking stock to a papermachine, said apparatus comprising a vessel for receiving and mixing stock components and a pipe for feeding the resulting mixed stock to said papermachine. The feeding pipe has connected thereto stock flow metering means for continuously providing data on the volumetric flow (Q) of stock through said pipe; stock consistency sensing means for continuously providing data on the consistency (C) of said stock; and stock flow control means for adjusting said flow. All of said means are connected to a control system adapted for receiving said flow data and said consistency data. The control system is adapted for continuously computing a value for the product (Q×C) of said flow data and said consistency data, and for comparing said computed value to a target value of said product, and for providing adjustment of said flow control means in response to deviations in said computed value from said target value.

Contrary to prior art processes, the control system of the present invention is adapted for providing adjustment of the flow only, in response to deviations in the computed value caused by variations in the consistency. The system does not require a constant flow nor a constant consistency but makes sure of a constant feed of solid material by keeping the product of flow and consistency at a constant value.

In the preferred embodiment of the invention the apparatus includes a relatively small stock mixing vessel placed on top of a pressure pipe connected to said feeding pipe. The vessel is preferably provided with a stock mixer, a level sensor and individual inlets for stock components.

The process aspect of the invention defines a process for producing paper or the like web-like material in a process which includes the steps of feeding stock components to a vessel and mixing them;

feeding the resulting mixed stock at a pressure through a feeding pipe to a papermachine while continuously measuring the volumetric flow (Q) and the consistency (C) of said stock and computing a value for the product (Q×C) of flow and consistency; and adjusting said flow (Q) to compensate for deviations in said computed value from a target value of said product (Q×C).

In the preferred embodiment of the invention stock components are fed individually at their respective consistencies to the mixing vessel. The stock components may of course be fed also in the form of mixtures of components. The volumetric flows of components into the vessel are metered and adjusted individually according to the grade of paper being produced.

The components are mixed in the vessel without providing dilution of the components in said vessel. The mixed stock will consequently have the consistency resulting from the consistency of the individual components.

In the prior art a consistency of about 3% was provided in the mixing tanks. In the present process, however, the stock will preferably have a much higher consistency. A consistency between 4% and 8%, and more preferably between 5% and 6% is advantageous. The consistency is in principle limited only by the ability of the mixer in the mixing vessel to provide a proper mixing of the stock components. Thus, with a good shearing mixer the consistency may be as high as 10% or more. Higher consistencies will require fluidization for proper mixing. Such a concept will, however, have its advantages and it is not excluded from the scope of the present invention.

Providing a higher consistency of the stock entering the papermachine will reduce the amount of water in the process and especially the amount of water discharged from the process into the environment. Increasing the consistency from 3% to 6% reduces the amount of excess water discharged from the process by about 50% to 60%. This is beneficial also from the environmental point of view.

In the preferred embodiment of the apparatus according to the invention the stock mixing vessel with its mixer stock level sensor is placed in the upper end of the feeding apparatus on top of a high pressure pipe. The pressure pipe is preferably essentially vertical and it connects the mixing vessel to a stock pump. The pressure pipe should be dimensioned for a moderate velocity flow of stock, so that friction is kept low, the flow will be a plug flow (e.g., laminar or, e.g., uniform velocity flow) and no separation between stock and water will occur. Dimensioning will thus be made for a flow speed, which is normally between about 3 and about 0.1 m/s, favourably between about 1 and about 0.3 m/s.

The mixing vessel of the preferred embodiment of the invention is tiny compared to the prior art huge mixing chests. However it preferably has a relatively large upper diameter, allowing for an accurate level control. The vessel is preferably of a conical shape, with the tapering end connected to the vertical pressure pipe. The diameter at the top of the mixing vessel, depending on the flow volume to be processed will, typically, be between about 1 meter and about 5 meters. The diameter and volume of the mixing vessel should be selected so as to enable combining an intensive mixing with a stable level control.

The vertical distance between the operating stock surface in the mixing vessel and the suction connection of the stock pump should be adequate for providing a good and regular function of the stock pump. The distance between stock surface level and pump should preferably be not less than about 2 m, more preferably 4 . . . 6 m. It may, however, be even greater.

The mixer of the mixing vessel is favourably of a vertical, pending type, and positioned centrally in order to cause a good and even mixing in the entire mixing vessel volume. As is obvious to those skilled in the art, the mixing vessel may be of a different shape and the mixer may be of another type. The invention, however, functions better when the volume of the vessel is fairly small. Ideally the volume of the mixing vessel should correspond to about 10 to about 30 seconds of thick stock flow. The smaller the volume can be made, the faster will be the response to changes. If the vessel is larger, it may be favourable just before a grade change to temporarily decrease the level in the vessel, in order to minimize the volume of mixed stock when changing paper grade.

According to the invention, the flow of dry stock at any given moment is controlled and kept constant. The volumetric flow Q, given by a flow meter, is multiplied with the consistency C given by a consistency sensor. Keeping the product Q×C constant ensures that the flow of dry stock is kept constant.

This novel approach to stock feeding control provides a fast and accurate metering of the papermaking stock. It avoids any delay caused by the slowness and inaccuracy of conventional consistency control circuits. Moreover, unnecessary dilution of the stock is avoided and the amount of excess water in the short circulation is dramatically reduced.

The dry stock flow control of the present invention is insensitive to consistency variations, as long as these are slower than the response time of the consistency measuring and flow control apparatuses. Component feed variations of a short duration, i.e. lasting less than about one second will be efficiently compensated in the mixing vessel, whereas remaining longer duration variations will be compensated by adjusting the volumetric flow to obtain a constant dry stock flow. Thus, the need for the prior art large mixing and machine tanks is eliminated.

The present invention, together with additional objects and advantages will be best understood from the following description, when read in connection with the accompanying drawings, of which FIG. 1 shows an apparatus with control devices according to a preferred embodiment of the invention;

Figure 1:
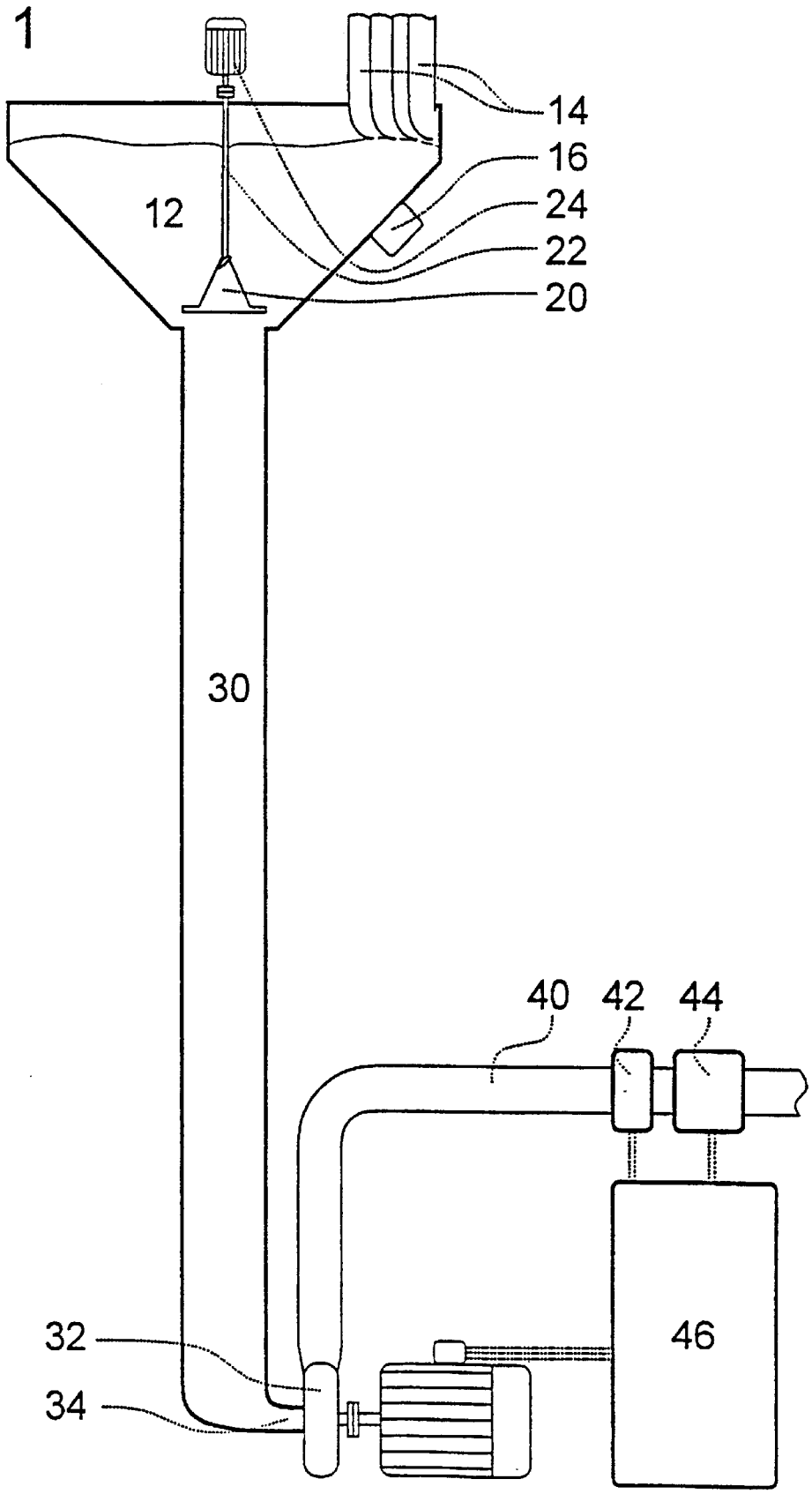

A preferred embodiment of a stock mixing and feeding apparatus as indicated by a general reference 10 is shown in FIG. 1. The apparatus comprises a mixing vessel 12, with a mixer 20, the mixing vessel being connected to a substantially vertically extending pressure pipe 30. The pressure pipe is connected to a stock feeding pipe 40 for delivering the stock to the papermachine. A stock feeding pump 32 is preferably placed between the pressure pipe 30 and the feeding pipe 40, but the pump 32 may also be omitted, especially if the invention is applied to conventional paper making processes.

The mixing vessel 12 has means 14 for introducing stock components, preferably arranged so as to avoid splashing of material being introduced, in a way which is known to persons skilled in the art. The means 14 are favourably pipes, connected to flow controllers for proportioning the component flow according to any desired stock formulation. The mixing vessel is further preferably equipped with a level sensor 16 of any one of several known types, for detecting the level of stock contained in the vessel.

The mixing vessel 12, as shown in FIG. 1 is favourably of a conical shape, so that the upper surface of stock contained in the vessel is large compared to the stock volume. The volume of the mixing vessel is as small as practically possible for the stock to be properly mixed. The vessel volume favourably corresponding to a retention time of 5 to 120 seconds, preferably from about 5 to about 20 seconds. In cases where rapid grade changes are particularly important, the vessel may be even smaller and that its volume may even be almost eliminated, the upper portion of the pressure pipe constituting a mixing vessel.

The mixer 20 of the embodiment of FIG. 1 has a vertical shaft 22 directly connected to a driving motor 24 and is arranged centrally above the transition between mixing vessel 12 and pressure pipe 30. Even if this is considered to be the most advantageous arrangement, ensuring that stock entering the pressure pipe 30 is duly mixed, many alternative solutions may be applied as will be evident to those skilled in the art. The mixer 20 may favourably be equipped with a variable speed drive, for decreasing mixing intensity when decreasing the level of stock in the mixing vessel.

The pressure pipe 30 should be dimensioned so that the stock flows through it essentially at a plug flow of sufficient speed for avoiding precipitation of solids or re-separation of its components. A fast flow is favourable for a fast control of the stock formulation, but the flow should not be so fast that it causes excessive frictional losses. Thus, the pressure pipe should be dimensioned according to the desired flow rate of stock. The flow rate will normally be in the range between 0.2 and 5 m/s, favourably in the range between 0.5 and 3 m/s.

At its bottom end the pressure pipe 30 is connected to or transforms into a suction pipe 34 for the stock pump 32. The transition between pressure pipe 30 and suction pipe 34 is preferably smooth and gradual. Similarly, the shape of the pressure pipe 30 and the transition between pressure pipe 30 and mixing vessel 12 may be made in a smooth way, so that the diameter of the mixing vessel decreases gradually to form the pressure pipe without a distinct transition.

The stock feeding pipe 40 of the embodiment of FIG. 1 is equipped with a flowmeter 42 and a consistency transmitter 44, connected to a control system 46. The consistency transmitter 44 is preferably a transmitter based on microwave technology, or another type of sensor which should preferably be as insensitive to flow speed, stock composition, temperature or stock composition as possible. Obviously, also conventional mechanical sensors, based on friction or viscosity measurement may be used, but these yield a result which is less dependable if conditions vary a lot.

The control system 46 may be of any known type, centralized or decentralized, which is capable of computing and controlling the flow of dry substance as a product of volumetric flow (Q) and consistency (C). Any computer or logic circuit which can be programmed to perform the computation and to provide a corresponding adjusting output, may be used.

In the preferred solution of FIG. 1, the control system 46 comprises computer having an output for providing rotation speed control of the motor 36 of stock pump 32 for controlling stock flow. The flow control may, however, be effectuated by other known means, like throttling a control valve or the like.

When feeding a papermachine with a conventional open backwater system, the pressure pipe 30 may be built high enough, so that the mixing vessel can act like a constant level high feeding box, and the stock be fed to the paper machine short circulation over a basis weight control valve in a conventional manner. In such a case the pump 32 may be omitted.

The control system **4*b* of FIG. 1 is also connected to level sensor 16 and flow controls of feeding means 14** for controlling the proportioning of stock components.

During operation, stock is fed to the papermachine at a desired rate of solids flow, controlled by a control system on the basis of stock consistency C and volumetric flow Q. The components forming the stock formulation are fed to a mixing vessel of small volume and are rapidly mixed together therein. The mean retention time in the mixing vessel is favourably less than two minutes, preferably less than 20 seconds.

The flow of stock components is proportioned to a desired stock formulation by a separate control system, so that the level in the mixing vessel is kept at a desired level. The components are fed into the vessel in a manner which is arranged to avoid splashing.

The consistency of the components is generally such that it provides a mixed stock having a consistency of about 5–6% or any one which allows handling thereof by pumping. Since the present invention monitors the feed of dry solid matter, the consistency of the stock in the mixing vessel may preferably be that provided by the stock components. No dilution at this stage is necessary.

From the mixing vessel the mixed stock flows toward the paper machine short circulation through a pressure pipe having a sufficient vertical extension for generating a pressure required for a stable feeding into a stock pump or alternatively, without pumping into the short circulation. The flow speed in the pressure pipe should comprise a plug flow without excessive friction losses. The flow rate is advantageously about 0.2 to 5 m/s, preferably about 0.5 to 3 m/s.

Before entering the short circulation, the stock consistency C and volumetric flow Q are measured, and the values obtained are used by the control system as input data for controlling the flow to provide a constant flow of solids (Q×C). A typical process for producing paper may require 3 kg of dry stock per second (about 10800 kg/h) corresponding to a flow of 50 l/s of stock at 6% consistency containing 60 g/l. The computer will be set for keeping a target value (Q×C) of 3000 g/s and will adjust the flow Q to keep this value constant.

At a grade change, the proportioning of stock components is changed, and the stock composition in the mixing vessel gradually, although rapidly, due to the small size of the vessel, changes to correspond to the new formulation. If mixing is ideal, 90% of the material will have changed when material corresponding to 2.29 times the mixer vessel volume has passed out the vessel. In practice mixing is not quite ideal, so the stock composition changes faster, approximately 90% for every time interval corresponding to two times the mean retention time.

If the mean retention time in the mixing vessel is 5 seconds, 90% of the material will have changed every 10 seconds. This is adequate for supporting the rapid grade changes made possible by the novel papermachine process presented by the same inventor in the above mentioned WO 93/23612 patent Fl 89728. In cases, when a still faster change is required, this is favourably obtained by reducing the stock volume in the mixing vessel by decreasing the level therein prior to a grade change.

From the mixing vessel the stock flows into a pressure pipe of vertical extension, in which it favourably flows in a plug flow mode, i.e. without further mixing. The plug flow signifies that stock leaving the mixing vessel will reach the end of the pipe in its original composition at a time lag of known duration.

In the preferred embodiment of FIG. 1, the pressure pipe leads to the suction side of a stock pump feeding the stock to the papermachine short circulation, where it is diluted and further processed. The stock pump is needed when the papermaking process is one corresponding to the compact process of WO 93/23612. The pump may be omitted if the papermaking process is a conventional one with an open backwater tank.

The consistency of the stock is measured by a consistency C gauge and the flow Q by a flowmeter, both connected to a control system for computing and controlling the flow of solid material. In the embodiment of FIG. 1 the flow control is provided by means of controlling the rotational speed of the stock pump. The control may, however, equally well be made by a control valve. Especially with conventional papermaking processes it is favourable to use the mixing vessel as a constant level box and to control the flow over a basis weight valve.

Controlling the flow is much faster than controlling the consistency and it is possible to monitor and adjust the flow in response to any short term consistency variations which may occur in the pumped stock due to the small volume mixing vessel. The need for a separate consistency control, after mixing is thus eliminated. The flows of the stock components which are fed to the mixing vessel, may favourably be controlled in a similar way. Separate component feeding allows the preparation of single components to be made more compact and the total lead time for a grade change or corrective action may be significantly reduced. In order to minimize the control time constant the consistency is favourably measured as close to the subsequent dilution as possible.

If the down-stream end of the papermachine signals that the speed of paper produced can be increased or should be decreased due to, for instance the capacity of the drying section, the volumetric flow of all stock components fed to the vessel will be adjusted. The control system will receive a new target value for the product Q×C and will adjust the volumetric flow Q in the feeding pipe to reach the new target value.

Figure 2:
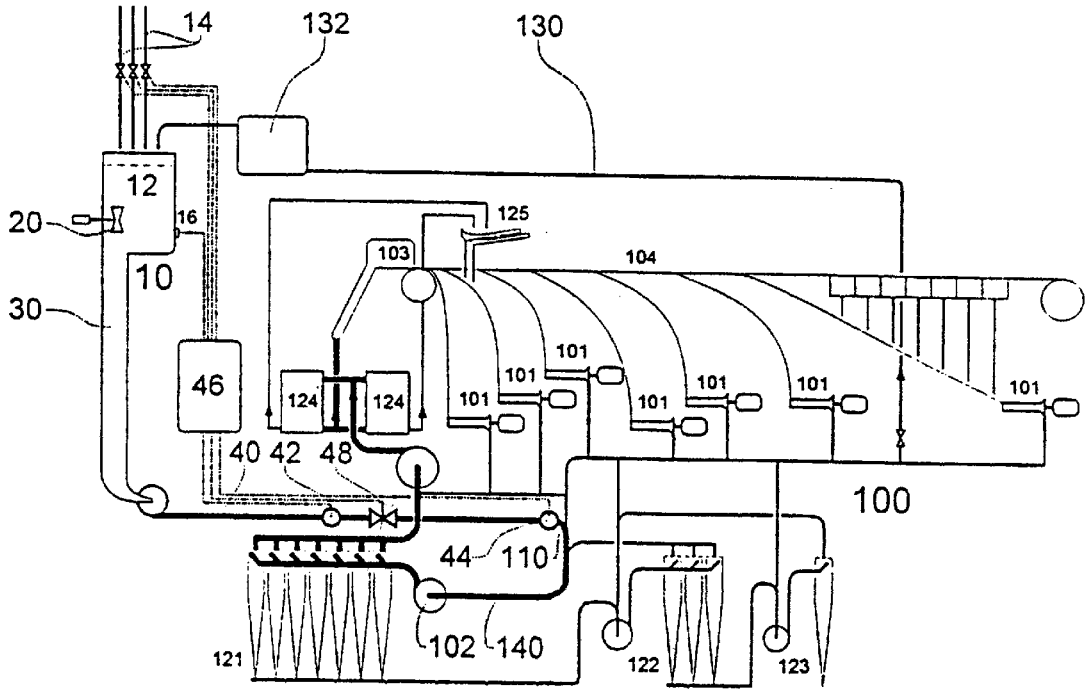
FIG. 2 shows a papermaking process including a stock feeding arrangement according to the invention.

FIG. 2 represents another embodiment of the invention in combination with a compact papermachine circulation system 100 and a disk filter 150 for fiber recovery. In FIG. 2 the mixing vessel 12 is of a different shape from that of FIG. 1 and the mixer 20 is mounted horizontally. The feeding lines 14 for stock components have flow control valves 18 connected to a control system (not shown). The feeding pipe 40 is equipped with a flow meter 42, a control valve 48 and a consistency gauge 44. The consistency gauge is placed close a the first stock dilution point 110, connected to the papermachine backwater circulation system. The feeding pipe 40 is connected to a stock mixing pump 102 by a pipe 140 for diluted stock. The backwater circulation system has a pipe for excess backwater 130 connected to a fibre recovery unit 150.

During operation, fresh stock components are fed into the mixing vessel, by a proportioning control system which may be interconnected to the flow and consistency control system 46. Excess backwater from the papermachine circulation system is passed through a fiber recovery unit, and the recovered material is brought to the mixing vessel.

The stock flow from the mixing vessel 12 through the pressure pipe 30 is controlled by the control system 46 by means of a control valve 48, throttling the flow so that a desired flow of solid or dry substance is maintained. Any consistency variations and possible irregularities in the previous process are detected by a consistency gauge and compensated by the control system by changing the flow rate as measured by a flowmeter. Thus the need for separate consistency adjustment is avoided.

The stock is brought to flow to the papermachine circulation system at a first dilution point, which may be either included in a hydraulically closed circulation system, or at the suction side of a mixing pump connected to an open back water tank. In the embodiment of FIG. 2, the first dilution point occurs just prior to a first cleaning stage 121 with a set of conventional cleaners.

Further dilution points are between the first cleaner stage 121 and primary screens 124 and at the feeding pumps of secondary cleaner stages 122, 123. The dilution water is provided from the papermachine forming section 104 by air separating pumps 101. The accept stock of screens 124 is fed to the head box 103 and further to the forming zone 104. The excess water from the papermachine is brought through an excess water discharge pipe 130 to fibre recovery 132, and recovered solid material is returned to the mixing vessel 12.

In a compact circulation process according to the above mentioned WO 93/23612, the first dilution point would be in the extension of the stock feeding pipe, just after the consistency transmitter.

From the first dilution point, the stock is brought further through various process steps, like cleaning screening and web forming on a former, wet pressing, drying, and various types of finishing thus to processing the stock to finished paper in a manner known to those skilled in the art.

Figure 3:
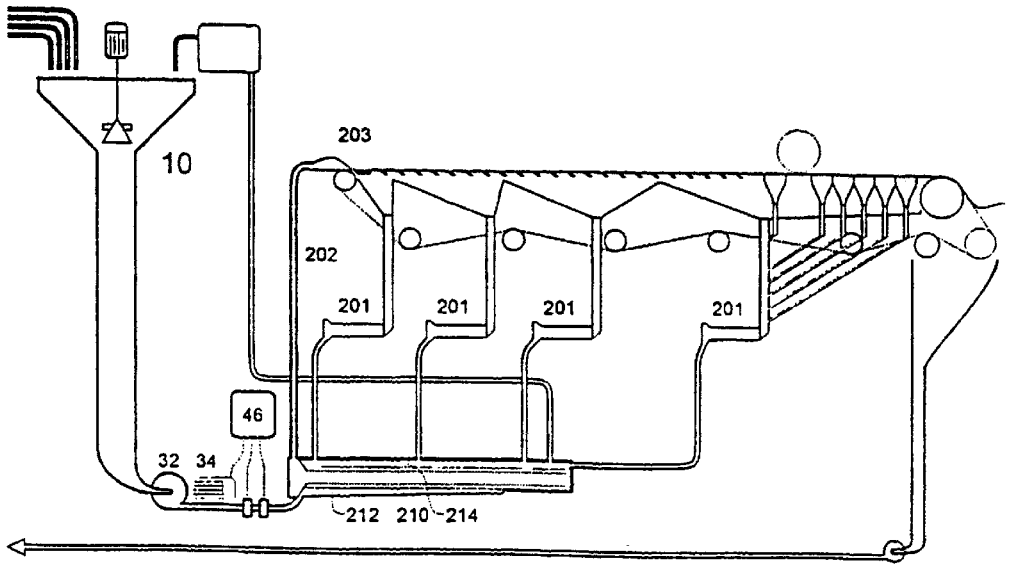
FIG. 3 shows a particularly favourable papermaking process embodying to the invention.

FIG. 3 represents a particularly favourable use of the invention in connection with a papermaking process, such as the one presented in copending patent application PCT/FI95/00643 assigned to the same applicant. The disclosure of said application is considered incorporated herein by reference. In the embodiment of FIG. 3 the stock feeding pipe 40 is connected to the thick stock feeding nozzle 212 of the screen 210, which is a screen in accordance with the above mentioned PCT/FI95/00643. The consistency transmitter 44 is placed close to the screen 210, permitting a very fast response of the control system 46, controlling the dry stock flow Q×C by means of a variable speed motor 34 of stock pump 32.

Backwater from the former is fed to the dilution nozzle of the screen 210 by means of air separating pumps 201 so that all dilution stages of the process are incorporated into the screen 210, the first dilution stage being at the combined inlet and outlet end of the screen. The diluted stock is fed directly from the screen 210 through a distributing piping 202 to the head box 203. Thus, a papermaking process with a very short response time to changes is obtained.

The invention has been decsribed in detail in connection with the production of paper in specific embodiments of papermaking processes. However, the present invention should not be considered as being limited to the described embodiments only but the invention includes all variations and modifications which are within the skills of an average expert and which fall within the scope of the appended claims.

What is claimed is:

1. An apparatus for feeding papermaking stock to a paper machine, said apparatus comprising:

a stock-mixing vessel (12) for receiving and mixing stock components, a feeding pipe (40) located substantially below said vessel (12) for feeding the resulting mixed stock from said vessel (12) to the papermachine, and an elongated pressure pipe (30) extending downwardly from said stock-mixing vessel (12) to said feeding pipe (40), said feeding pipe (40) having connected thereto a stock flow metering means (42) for continuously providing data on the volumetric flow (Q) of stock through said pipe (40);

stock consistency sensing means (44) for continuously providing data on the consistency (C) of said stock; and stock flow control means (32; 48) for adjusting said flow (Q), all of said means being connected to a control system (46) adapted for receiving said flow data (Q) and said consistency data (C), wherein said stock-mixing vessel (12) is provided with a stock component mixer (20), a level sensor (16) and inlets (14) for stock components, and wherein said control system (46) is adapted for continuously computing a value for the product (Q×C) of said flow data (Q) and said consistency data (C), and for comparing said computed value to a target value of said product (Q×C), and for providing adjustment of said flow control means (32; 48) in response to deviations in said computed value from said target value.

2. An apparatus according to claim 1, wherein said control system (46) is adapted for providing adjustment of said flow control means (32; 48) only, in response to deviations in said computed value caused by variations in said consistency (C).

3. An apparatus according to claim 1, wherein said flow control means comprise a means for adjusting the rotation of a stock pump (32) feeding stock into said feeding pipe (40).

4. An apparatus according to claim 1, wherein said flow control means comprise a means for adjusting a valve (48) in said feeding pipe (40).

5. An apparatus according to claim 1, wherein said stock consistency sensing means (44) comprises a transmitter based on micro-wave technology.

6. An apparatus according to claim 1, wherein said stock component inlets (14) are provided with flow control and metering means for feeding individual stock components or mixtures of stock components at an adjustable volumetric flow into said vessel (12).

7. An apparatus according to claim 1, wherein said vessel (12) comprises means for holding a stock volume corresponding to a retention time of about 5 to about 120 seconds.

8. An apparatus for feeding papermaking stock to a papermachine, said apparatus comprising a vessel (12) for receiving and mixing stock components and a pipe (40) with a stock pump (32) for feeding the resulting mixed stock to said papermachine, said feeding pipe (40) having connected thereto stock flow metering means (42) for continuously providing data on the volumetric flow (Q) of stock through said pipe (40);

stock consistency sensing means (44) for continuously providing data on the consistency (C) of said stock; and stock flow control means (32:48) for adjusting said flow (Q), said stock flow control means comprising means for adjusting the rotation of said stock pump (32) feeding stock into said feeding pipe (40), all of said means being connected to a control system (46) adapted for receiving said flow data (Q) and said consistency data (C), said apparatus further comprising a downwardly extending pressure pipe (30) connected to said feeding pipe (40) from said vessel (12), and said vessel includes a stock component mixer (20), a level sensor (16), and inlets (14) for stock components, and wherein said control system (46) is adapted to continuously computing a value for the product (Q×C) of said flow data (Q) and consistency data (C), and for comparing said computed value to target value of said product (Q×C), and for providing adjustment of said flow control means (32;48) in response to deviations in said computed value from said target value;

wherein said pressure pipe (30) comprises means for maintaining a plug flow of said mixed stock and is connected directly to a suction pipe (34) of said stock pump (32).

9. An apparatus according to claim 1, wherein said vessel (12) has a conical configuration with an upper diameter of about 1 m to about 5 m and with its tapering end connected directly to an upper end of said pressure pipe (30), the height of which is about 2 m to about 6 m.

10. A process for producing paper or board in a papermaking process, said process comprising feeding stock components to a stock-mixing vessel placed on top of a downwardly extending pressure pipe, and mixing said stock components in said stock-mixing vessel;

feeding the resulting mixed stock first downwardly at a pressure through said pressure pipe and then through a feeding pipe to a papermachine while continuously measuring the volumetric flow (Q) and the consistency (c) of said stock and computing a value for the product (Q×C) of flow and consistency; and adjusting said flow (Q) to compensate for deviations in said computed value from a target value of said product (Q×C).

11. A process according to claim 10, comprising adjusting said flow (Q) only, in response to deviations in said computed value caused by variations in said consistency (C).

12. A process according to claim 10, comprising feeding stock components individually or as mixtures thereof at metered volumetric flows to said vessel and mixing them in said vessel without providing any significant dilution of said components in said vessel.

13. A process according to claim 12, comprising feeding said stock components to said vessel so as to provide a consistency of about 3% to about 10%, and feeding said resulting mixed stock without any significant dilution to said feeding pipe and into said papermachine.

14. A process according to claim 12, comprising adjusting said volumetric flows of said stock components, respectively, and/or said target value of said product (Q×C) to provide changes in the grade and/or the speed of paper being produced.

15. A process according to claim 12, comprising mixing in said vessel a stock volume corresponding to a retention time of about 5 to about 120 seconds.

16. A process according to claim 10, comprising providing said pressure in said feeding pipe by a stock pump and/or by feeding said mixed stock from said vessel to said feeding pipe through a generally vertical pressure pipe having a height which is adequate for providing, with the stock level in said vessel, the required pressure for feeding said papermachine.

17. The apparatus of claim 1 wherein said stock-mixing vessel (12) comprises means for holding a stock volume corresponding to a retention time for said stock of about 5 to 20 seconds.

18. The apparatus of claim 1 wherein said stock-mixing vessel (12) has a conical configuration with an upper diameter of about 1 meter to about 5 meters, and with its downwardly tapering end connected directly to an upper end of said pressure pipe (30), and wherein said pressure pipe (30) is vertically disposed and has a height of more than 6 meters.

19. The process of claim 12, comprising feeding said stock components to said stock-mixing vessel so as to provide a consistency of about 4% to about 7%, retaining said stock in said stock-mixing vessel for about 5–20 seconds, and feeding said resulting mixed stock without any significant dilution to said feeding pipe (40).

20. The process of claim 12, comprising feeding said stock components to said stock-mixing vessel so as to provide a consistency of about 5% to about 6%, retaining said stock in said stock-mixing vessel for about 5–20 seconds, and feeding said resulting mixed stock without any significant dilution to said feeding pipe (40).

* * * * *